US006283456B1

(12) United States Patent
Benz et al.

(10) Patent No.: US 6,283,456 B1
(45) **Date of Patent: *Sep. 4, 2001**

(54) SECTION BAR

(75) Inventors: Albrecht Benz, Leinfelden-Echterdingen; Joerg Walther, Korntal; Johannes Koban, Stuttgart; Olaf Klemd, Markgroeningen; Armin Breitenbücher, Pluederhausen, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/196,287

(22) Filed: Nov. 19, 1998

(30) Foreign Application Priority Data

Nov. 19, 1997 (DE) ..... 197 51 167

(51) Int. Cl.[7] ..... E04H 17/16

(52) U.S. Cl. ..... 256/24; 256/73; 52/731.2; 160/391

(58) Field of Search ..... 256/24, 25, 32, 256/33, 47, 73, 1; 160/391, 395, 381; 52/731.2, 732.1, 732.2, 737.6, 731.5, 731.9, 482, 775, 781

(56) References Cited

U.S. PATENT DOCUMENTS

| | | | | |
|---|---|---|---|---|
| 1,567,446 | * | 12/1925 | McClure | 160/391 |
| 3,385,567 | * | 5/1968 | Case et al. | 256/24 |
| 3,770,245 | | 11/1973 | Murdock . | |
| 3,973,756 | * | 8/1976 | Lauzier | 256/21 |
| 4,110,942 | * | 9/1978 | Slocomb, Jr. | 52/100 |
| 4,132,390 | | 1/1979 | Pfarr, Jr. . | |
| 4,333,284 | * | 6/1982 | Meadows | 160/395 X |

(List continued on next page.)

FOREIGN PATENT DOCUMENTS

| | | |
|---|---|---|
| 709 995 | 5/1968 | (BE) . |
| 2 011 657 | 10/1970 | (DE) . |
| 79 06 346 | 7/1979 | (DE) . |
| 34 38 365 | 4/1986 | (DE) . |
| 86 32 787 | 3/1987 | (DE) . |
| 39 00 411 | 7/1990 | (DE) . |
| 91 00 699 | 5/1991 | (DE) . |
| 91 03 993 | 12/1991 | (DE) . |
| 42 08 720 | 9/1993 | (DE) . |
| 94 03 048 | 6/1994 | (DE) . |
| 43 07 492 | 9/1994 | (DE) . |
| 196 16 094 | 9/1996 | (DE) . |
| 297 01 455 | 6/1997 | (DE) . |
| 0 443 441 | 8/1991 | (EP) . |
| 2 309 695 | 11/1976 | (FR) . |

OTHER PUBLICATIONS

Information Sheet, Minitech, Linear Drive Element and Assembly Systems GmbH, Distributed Sep. 23–26, 1997 in the Exhibition Hall Sinsteim, Neulandstrasse 30, D–74889 Sinsteim.

*Primary Examiner*—Harry C. Kim
(74) *Attorney, Agent, or Firm*—Kenyon & Kenyon

(57) ABSTRACT

A section rod is a component of a protective fence and serves for fastening a protective screen. A U-shaped receptacle, where the protective screen can be secured, is provided in the section rod. For this purpose, the receptacle has an internal width that is at least in part somewhat less than a thickness of the protective screen. An increased securing action can be achieved through additional sawtooth-shaped elevations. The section rod allows the protective screen to be mounted in a simple and reliable manner without additional fastening or securing parts.

19 Claims, 4 Drawing Sheets

U.S. PATENT DOCUMENTS 4,623,128 * 11/1986 Dutch et al. ..... 256/65
4,712,942 * 12/1987 Brown ..... 403/231 X
5,265,972 * 11/1993 Bahr ..... 403/230 X
5,551,205 9/1996 Kidder .
5,647,181 * 7/1997 Hunts ..... 52/282.1
6,003,279 * 12/1999 Schneider ..... 52/481.1

* cited by examiner

FIG. 1
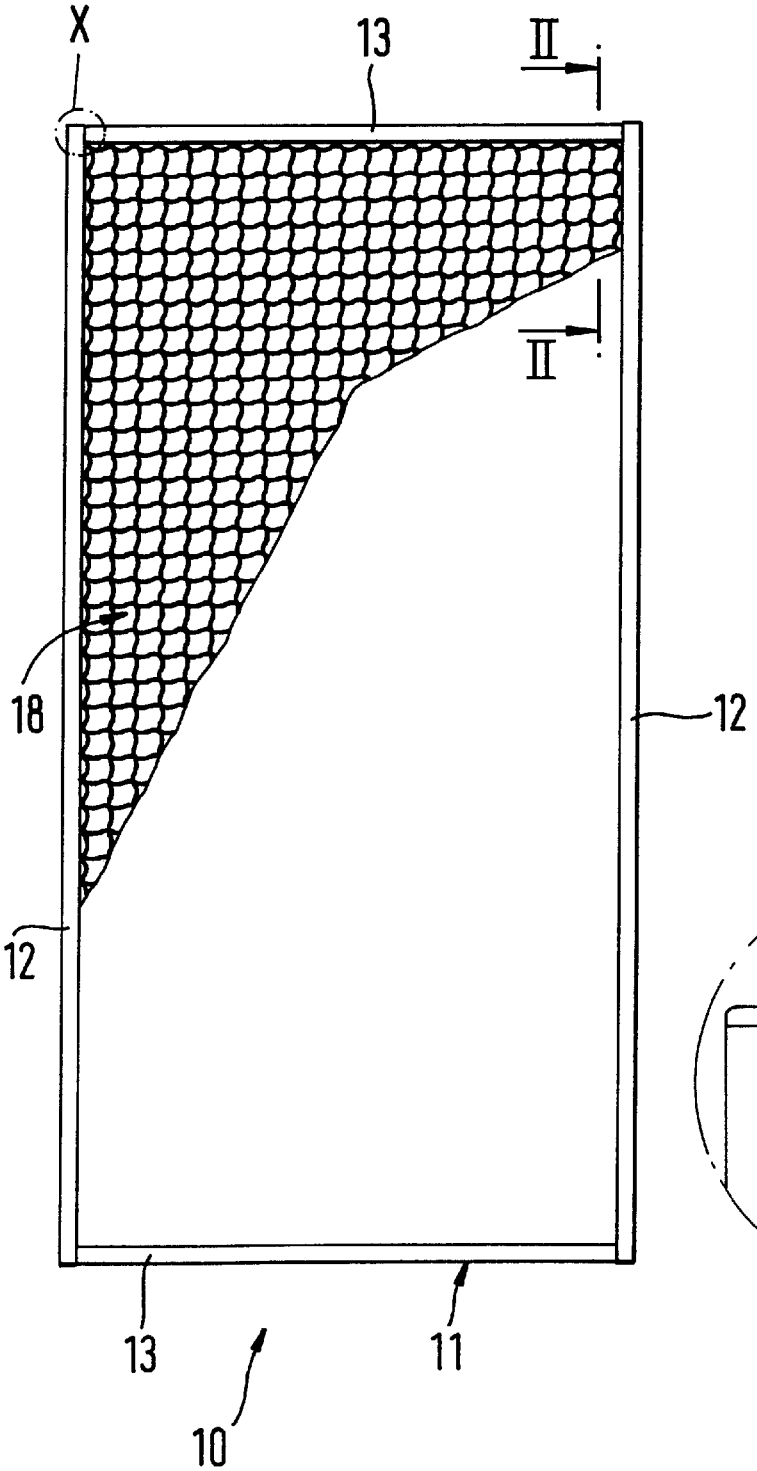
FIG. 2
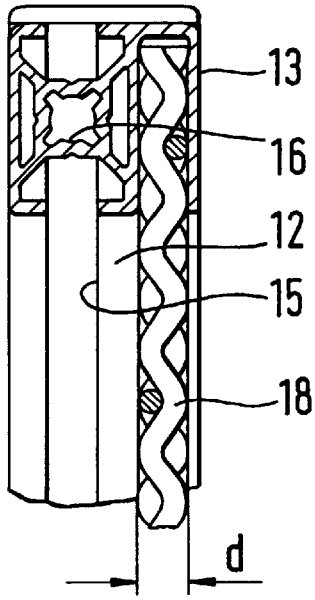
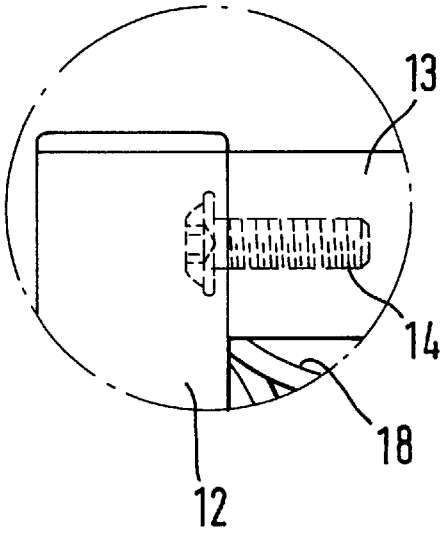
FIG. 3

SECTION BAR

BACKGROUND INFORMATION

A conventional section bar is described, for example, in German Patent No. 91 03 993. This conventional section bar, which is used as a frame element for the construction of a protective fence, has undercut longitudinal grooves on its sides with a protective screen projecting into the longitudinal groove. In order to secure the protective screen in the longitudinal groove, a wedge-shaped piece is used, which jams the protective screen in the area of the groove opening. The use of an additional wedge results in increased expense in manufacturing such protective fences. Furthermore, due to the fact that the protective screen is connected to the section bar only in the area of the longitudinal groove, a relatively high jamming tension is required to firmly secure the protective screen. In addition, the almost linear jamming of the protective screen in the section groove has the effect that, in the event of a transversal load on the protective screen, this small jammed area acts as a joint, and therefore the protective screen is deformed even under the effect of a moderate load on the entire jammed area.

German Patent No. 39 00 411 describes a section rod which includes grooves and recesses on boundary walls of receptacle grooves, the grooves and recesses functioning to accommodate excess adhesive material, if the walls of a trunk have profiles adhered to them. The peaks of the grooves do not protrude over one of the side walls of the plane formed by the receptacle grooves. The reason for this is that the grooves function to accommodate excess adhesive material, and have no influence on the retention force for the walls of the trunk.

In German Patent No. 43 07 492, a rubber seal having sealing lips for a flat element is shown. The element is inserted together with the flat element into a longitudinal groove. The rubber seal, however, is very soft. Thus, the rubber seal does not influence the retention force for the flat element.

In German Patent No. 42 08 720, a section rod is described which has a receptacle groove having two projections. These have a roughly round shape and are supposed to make possible improved support and two defined points or lines for a retaining element. While the support for the retaining element is good, the retention force for the retaining element is not improved when pulled out.

A profile element described in German Application 20 11 657 is made of an open seam tube of steel having an elliptical cross-section. Slotted edges are bent towards each other and lock in behind the protruding screen elements. Therefore, the external edges of an open seam tube having an elliptical cross-section are bent towards each other. The flat element is then made secure by being locked in.

SUMMARY OF THE INVENTION

A section rod according to the present invention is advantageous in that flat elements such as plates or screen-shaped elements can be reliably and directly connected to the section rod without additional fastening components. This is achieved through an advantageous design of the longitudinal groove, which allows the flat elements to be secured by clamping into the longitudinal groove over a relatively large clamping area. As a result of elevations, which function as barbs in response to the flat elements being pulled out, an additional increase in the retention force is achieved.

BRIEF DESCRIPTION OF THE DRAWINGS

FIG. 1 shows a front view of a protective fence produced using section rods.

FIG. 2 shows a section in a plane II—II of the rectangular frame illustrated in FIG. 1.

FIG. 3 shows two section rods secured in a partially sectioned side view of the rectangular frame, corresponding to detail X illustrated in FIG. 1.

DETAILED DESCRIPTION

Figure 4:
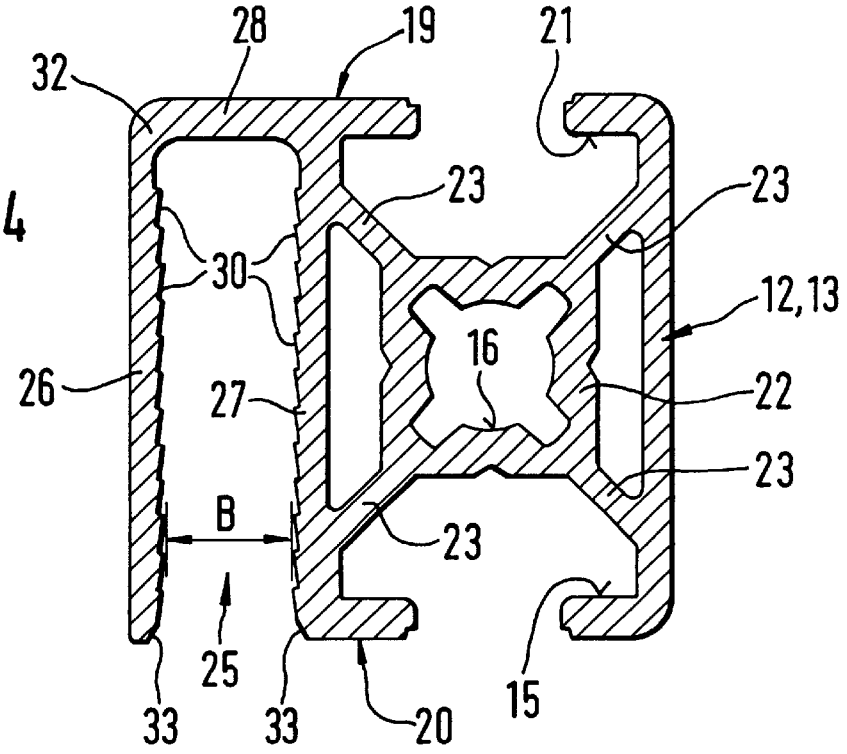
FIG. 4 shows a cross section through a first embodiment of a section rod.

FIG. 1 shows a flat element 10, used as a component of a protective fence such as a barrier in manufacturing shops to prevent access to certain areas. Element 10 has, in a simplest case illustrated in FIG. 1, a rectangular frame 11 with two longitudinal bars 12 and two cross bars 13 connected to them. Longitudinal bars 12 and cross bars 13, manufactured by a continuous aluminum drawing process, have different lengths; otherwise they are identical in design. Longitudinal bars 12 are connected to cross bars 13 at each corner using a connecting element (in the example illustrated in FIG. 1—a screw 14), whose head covers a first longitudinal groove 15 undercut on a lateral face of one of longitudinal bars 12 and cross bar 13, and can be screwed in into the end face of a through hole 16 of longitudinal bar 12 and cross bar 13 (shown in FIGS. 2 and 3).

A protective fence 18 is arranged within frame 11. Instead of protective fence 18, another element, for example, a plexiglass pane is also conceivable. Protective fence 18 has a thickness d which is greater than the actual wire thickness, since the wires of protective screen 18 are wavy and interwoven or welded.

In order to connect protective screen (fence) 18 to longitudinal bars 12 and cross bars 13 in a particularly simple and reliable manner, longitudinal bars 12 and cross bars 13 have an advantageous design. Longitudinal bar 12 and cross bar 13, having an approximately rectangular cross section and two undercut longitudinal grooves on two opposite side faces 19, 20, one of which is the first longitudinal groove 15 (described above) and the other will be referred to as second longitudinal groove 21. The two longitudinal grooves 15, 21 are used either as means to secure screw 14 and/or to secure additional elements, for example, warning signs, which are simply inserted in longitudinal groove 15, 21 and held there by jamming action.

In a mid-section 22, having a rectangular cross section, longitudinal through hole 16 has a conventional design between the two longitudinal grooves 15, 21. Mid-section 22 is connected to the remaining cross section through four webs 23, located in the extension of the imaginary diagonals of mid-sections 22.

Next to both longitudinal grooves 15, 21, there is a U-shaped receptacle 25 for protective screen 18. Receptacle 25 has two boundary walls 26, 27, one of which, boundary wall 26, forms a leg and at the same time a side wall of longitudinal bar 12 and cross bar 13. The other boundary wall 27 is connected to mid-section 22 through two webs 23 and forms the boundary walls of longitudinal grooves 15, 21.

It is preferable for the design of receptacle 25 that its internal width B is less, at least in a certain section, than thickness d of protective screen 18. Furthermore, bottom 28 of receptacle 25, which is at the same time part of side face 19 of longitudinal bar 12 and cross bar 13, is advantageously designed so that when protective screen 18 is inserted in receptacle 25, a certain elastic expansion is made possible through an appropriate wall thickness, i.e., design of receptacle 25 in the transition area 32 to boundary wall 26. Thus, protective screen 18 can be reliably secured in receptacle 25.

Additional increase in the securing force for protective screen 18 can be achieved if the areas of both boundary walls 26, 27 facing protective screen 18 are designed with the sawtooth-shaped elevations 30 illustrated in FIG. 4. These elevations 30 are arranged so that when protective screen 18 is pulled outward from receptacle 25, they act as retaining-hooks for protective screen 18.

Longitudinal bar 12 and cross bar 13, illustrated in FIG. 4, can be modified by forming additional longitudinal grooves on one or both side faces 19, 20 where longitudinal grooves 15, 21, serving to secure additional parts or as connections with other bars, are formed. It is also conceivable to have elevations 30 on boundary walls 26, 27 only in certain sections or only on one of the two boundary walls 26, 27.

Figure 5:
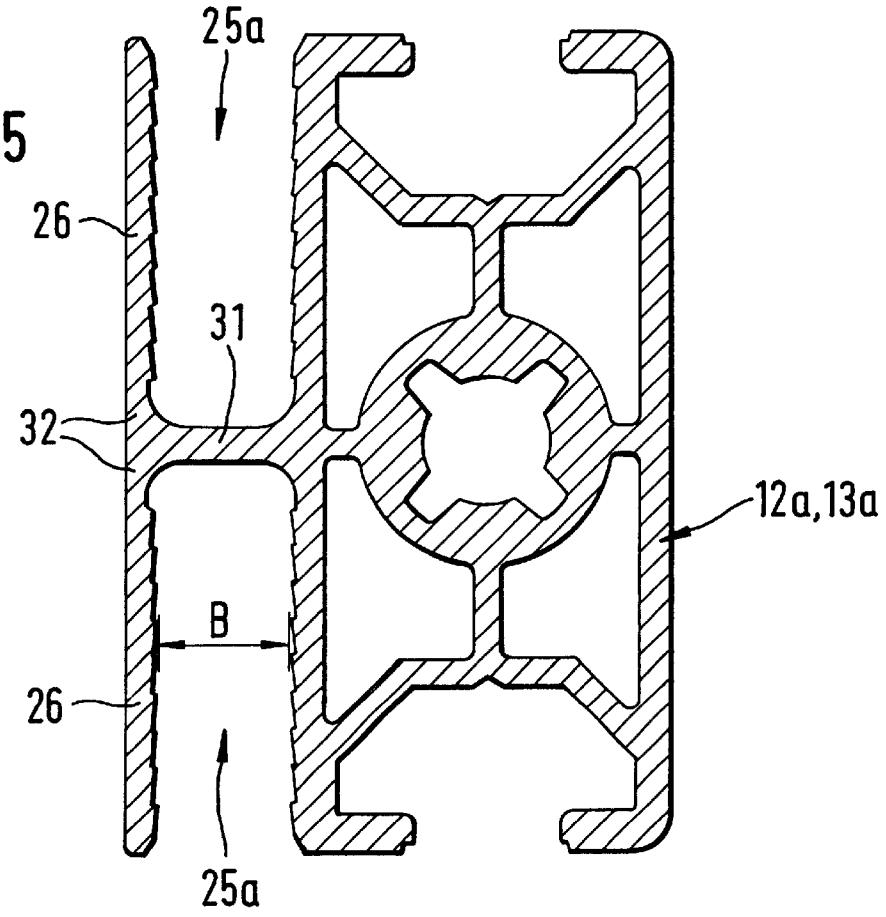
FIG. 5 shows a cross section through a second embodiment of the section rod.

A second embodiment of the present invention, illustrated in FIG. 5, differs from the first embodiment in that two receptacles 25*a* are provided opposite each other. This results in the depth of such a receptacle 25*a* being only approximately one-half of the width of a side wall. Furthermore, instead of bottom 28, an intermediate web 31 is provided, separating the two receptacles 25*a*. Section bar 12*a*, 13*a* illustrated in FIG. 5 is used, in particular, for dividing frame 11 horizontally or vertically.

It should also be mentioned that, in order to facilitate the insertion of protective screen 18 into receptacle 25, 25*a*, boundary walls 26, 27 on the side facing protective screen 18 are preferably provided with insertion bevels 33.

Figure 6:
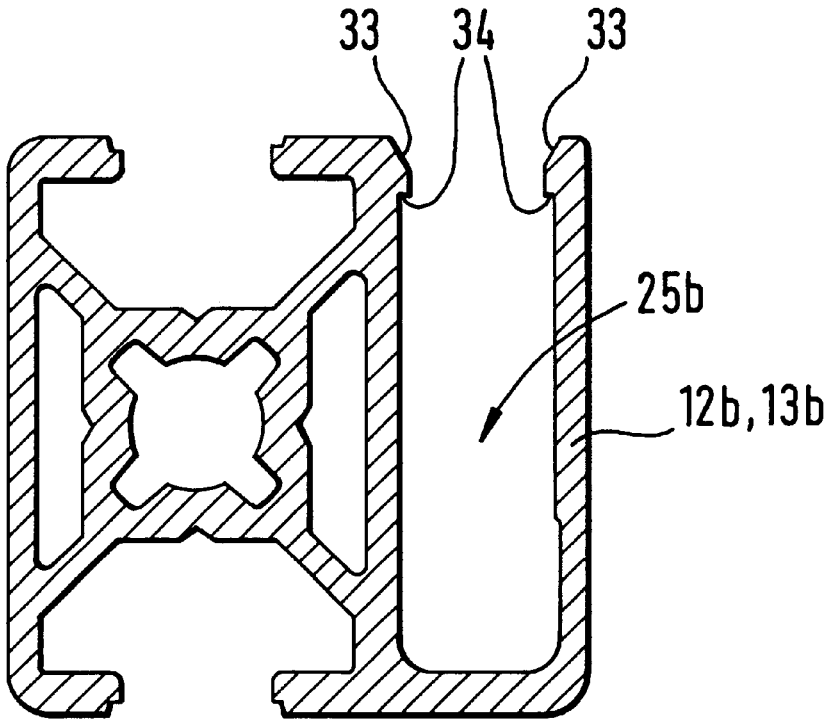
FIG. 6 shows a cross section through a third embodiment of the section rod.
Figure 7:
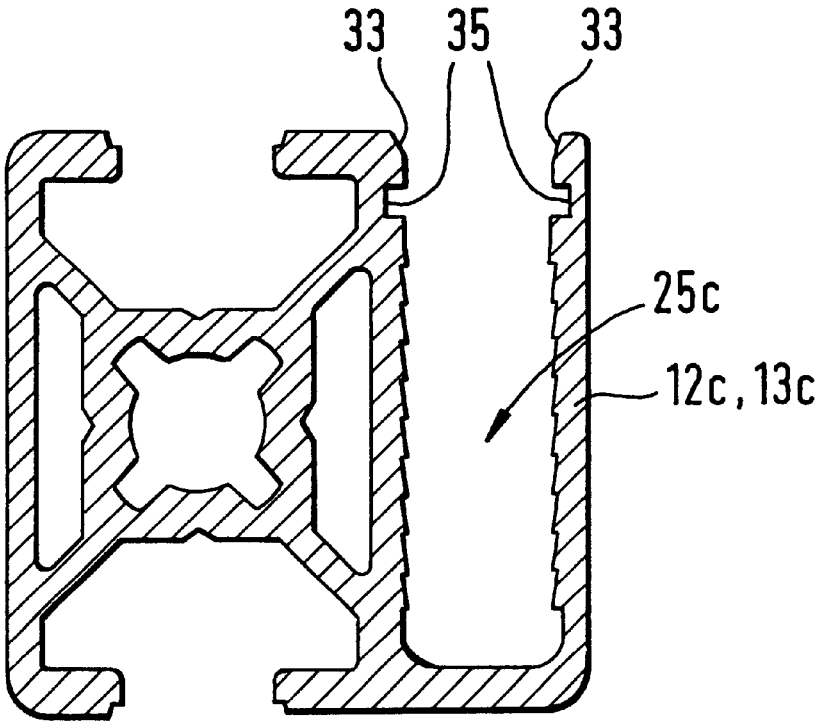
FIG. 7 shows a cross section through a fourth embodiment of the section rod.
Figure 8:
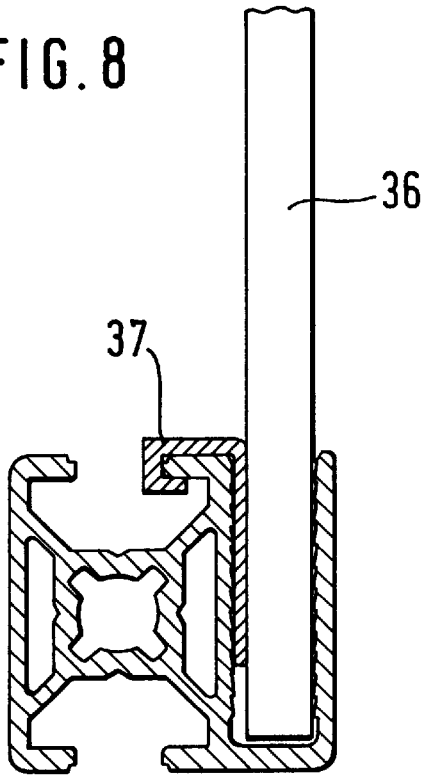
FIG. 8 shows a cross section through a first embodiment of a further arrangement having the section rods.
Figure 9:
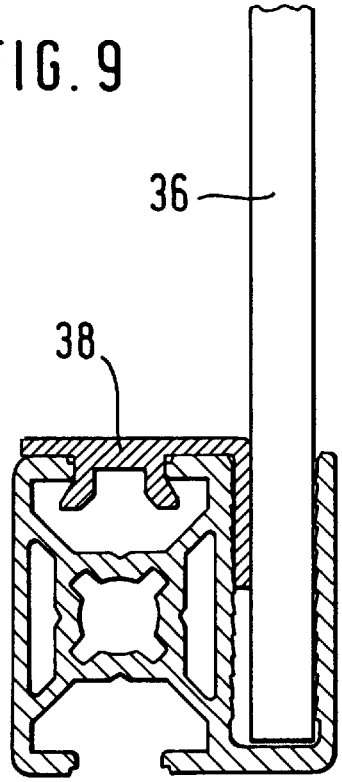
FIG. 9 shows a cross section through a second embodiment of the further arrangement having the section rods.
Figure 10:
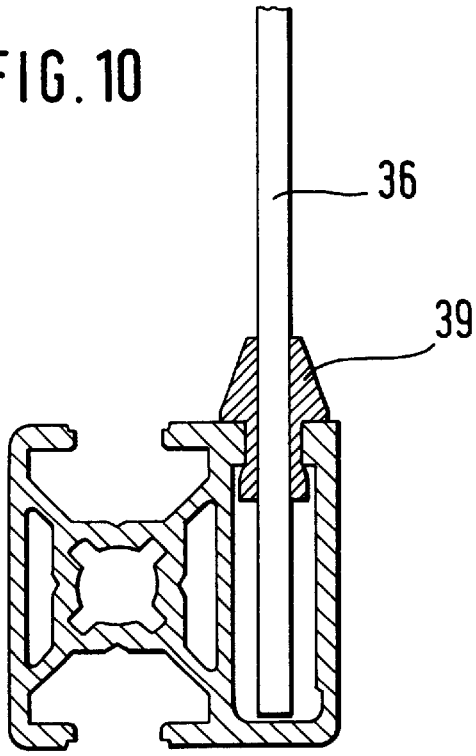
FIG. 10 shows a cross section through a third embodiment of the further arrangement having the section rods.
Figure 11:
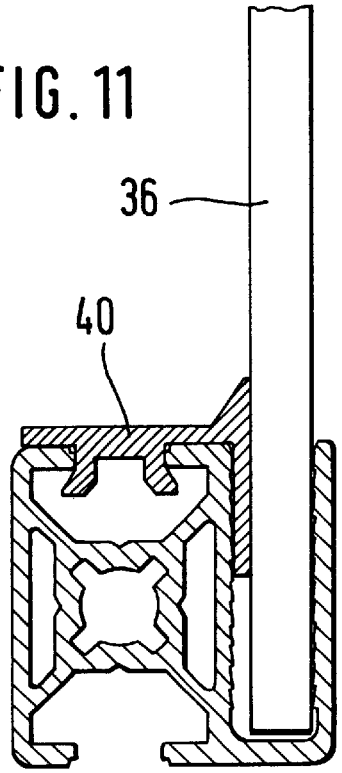
FIG. 11 shows a cross section through a fourth embodiment of the further arrangement having the section rods.

In two additional embodiments illustrated in FIGS. 6 and 7 of section bars 12*b*, 13*b* and 12*c*, 13*c*, their receptacles 25*b* and 25*c* can, in addition to their securing function, also have a function of sealing protective screen 18 using rubber gaskets placed into single-sided or double-sided undercuts 34 or small side grooves 35 in boundary walls 26, 27.

It should also be pointed out that receptacles 25, 25*a* through 25*c* may work together with grooves 15, 21 illustrated in FIGS. 8 through 11 in that thinner surfaces 36 or protective screens with additional securing elements or securing and sealing sections 37 through 40 arranged in groove 15, 21, or receptacle 25, 25*a* through 25*c* are provided. Thus the section bar may have different applications, including applications in clean rooms.

What is claimed is:

1. A section rod arrangement for use with a partition arrangement, the section rod arrangement comprising:

a section rod for securing at least one flat element and having at least one first longitudinal groove for receiving the at least one flat element, the at least one first longitudinal groove being provided on a longitudinal side of the section rod and including a U-shaped receptacle, the U-shaped receptacle having a width which is smaller, at least in a particular portion of the U-shaped receptacle, than a thickness of the at least one flat element on an edge area of the U-shaped receptacle facing the section rod, the width being smaller than the thickness to secure the at least one flat element in the section rod by clamping the at least one flat element into the U-shaped receptacle, the U-shaped receptacle including two boundary walls, at least one of the two boundary walls having at least partial elevations, the at least partial elevations functioning as barbs to the flat element in response to the flat element being pulled out of the U-shaped receptacle, and only one of the two boundary walls being movable with respect to another one of the two boundary walls for receiving the at least one flat element;

wherein the another one of the two boundary walls is not movable as is the one of the two boundary walls that is movable.

2. The arrangement according to claim 1, wherein the at least partial elevations include sawtooth-shaped elevations.

3. The arrangement according to claim 1, wherein the section rod has at least one second longitudinal groove which is provided on at least one of side faces of the section rod.

4. The arrangement according to claim 3, wherein the at least one second longitudinal groove is an undercut longitudinal groove.

5. The arrangement according to claim 1, wherein the section rod has a longitudinal hole for securing the section rod on a side face using a fastening element.

6. The arrangement according to claim 1, wherein a boundary wall of the U-shaped receptacle forms a leg which is at least a part of a side wall of the section rod.

7. The arrangement according to claim 6, wherein a bottom portion of the U-shaped receptacle is a part of a further side wall of the section rod.

8. The arrangement according to claim 1, wherein the U-shaped receptacle has an elastic area for affecting a securing action of the at least one flat element.

9. The arrangement according to claim 1, wherein the U-shaped receptacle has insertion bevels to receive the at least one flat element.

10. The arrangement according to claim 1, wherein the U-shaped receptacle has one of undercut grooves and further longitudinal grooves.

11. The arrangement according to claim 1, wherein the at least one first longitudinal groove includes a further U-shaped receptacle provided opposite to the U-shaped receptacle, and wherein the U-shaped receptacle and the further U-shaped receptacle are separated by an intermediary web.

12. The arrangement according to claim 1, wherein the at least one flat element includes one of a plate and a screen-type fence.

13. A section rod arrangement for use with a partition arrangement, the section rod arrangement comprising:

a section rod for securing at least one flat element and having at least one first longitudinal groove for receiving the at least one flat element, the at least one first longitudinal groove being provided on a longitudinal side of the section rod and including a U-shaped receptacle, the U-shaped receptacle having a width which is smaller, at least in a particular portion of the U-shaped receptacle, than a thickness of the at least one flat element on an edge area of the U-shaped receptacle facing the section rod, the width being smaller than the thickness to secure the at least one flat element in the section rod by clamping the at least one flat element into the U-shaped receptacle, the U-shaped receptacle including two boundary walls, at least one of the two boundary walls having at least partial elevations, the at least partial elevations functioning as barbs to the flat element in response to the flat element being pulled out of the U-shaped receptacle, and one of the two boundary walls being movable with respect to another one of the two boundary walls for receiving the at least one flat element, wherein the section rod has at least one second longitudinal groove which is provided on at least one of side faces of the section rod, and the at least one second longitudinal groove has a smaller depth than a depth of the U-shaped receptacle.

14. A section rod arrangement for use with a partition arrangement, the section rod arrangement comprising:

a section rod for securing at least one flat element and having at least one first longitudinal groove for receiving the at least one flat element the at least one first longitudinal groove being provided on a longitudinal side of the section rod and including a U-shaped receptacle, the U-shaped receptacle having a width which is smaller, at least in a particular portion of the U-shaped receptacle, than a thickness of the at least one flat element on an edge area of the U-shaped receptacle facing the section rod, the width being smaller than the thickness to secure the at least one flat element in the section rod by clamping the at least one flat element into the U-shaped receptacle, the U-shaped receptacle including two boundary walls, at least one of the two boundary walls having at least partial elevations, the at least partial elevations functioning as barbs to the flat element in response to the flat element being pulled out of the U-shaped receptacle, and one of the two boundary walls being movable with respect to another one of the two boundary walls for receiving the at least one flat element;

wherein:

the U-shaped receptacle includes a bottom section coupling the two boundary walls; and the at least partial elevations include sawtooth-shaped elevations beginning substantially adjacent to an opening of the U-shaped receptacle on each of the two boundary walls and extending substantially adjacent to a point defined by a transition area between the bottom section and the one of the two boundary walls that is movable.

15. The arrangement according to claim 14, wherein a wall thickness of the transition area allows a bending in the transition area so that the U-shaped receptacle is able to receive the flat element.

16. The arrangement according to claim 15, wherein the transition area includes a curved surface.

17. The arrangement according to claim 14, wherein the at least one flat element includes at least one of a partition and a fence.

18. The arrangement according to claim 14, wherein the at least one flat element includes at least one uneven surface for interfering with the at least partial elevations when the at least one flat element is being removed from the U-shaped receptacle.

19. The arrangement according to claim 14, wherein the another one of the two boundary walls is not movable as is the one of the two boundary walls that is movable.

* * * * *